US007980912B2

(12) United States Patent
Shoptaugh

(10) Patent No.: US 7,980,912 B2
(45) Date of Patent: Jul. 19, 2011

(54) TOY CONSTRUCTION SYSTEM WITH JAW COMPONENTS

(76) Inventor: Philip L. Shoptaugh, Oakland, CA (US)

( * ) Notice: Subject to any disclaimer, the term of this patent is extended or adjusted under 35 U.S.C. 154(b) by 1516 days.

(21) Appl. No.: 11/134,809

(22) Filed: May 20, 2005

(65) Prior Publication Data

US 2006/0264147 A1 Nov. 23, 2006

(51) Int. Cl.
*A63H 33/06* (2006.01)

(52) U.S. Cl. ..... 446/85; 446/120; 446/124

(58) Field of Classification Search ..... 446/85, 446/102–127
See application file for complete search history.

(56) References Cited

U.S. PATENT DOCUMENTS 5,704,186 A * 1/1998 Alcalay et al. ..... 446/120
5,769,681 A * 6/1998 Greenwood et al. ..... 446/120
5,957,744 A * 9/1999 Mott et al. ..... 446/127
6,030,270 A * 2/2000 Krog ..... 446/102
6,325,694 B1 * 12/2001 Clever et al. ..... 446/104
6,595,825 B1 * 7/2003 De Wilde ..... 446/102
6,926,242 B2 * 8/2005 Hall ..... 248/230.4

* cited by examiner

*Primary Examiner* — Gene Kim
*Assistant Examiner* — Urszula M Cegielnik
(74) *Attorney, Agent, or Firm* — Howard Cohen

(57) ABSTRACT

A toy construction set includes jaw pieces having jaws that interconnect with the body portions of other jaw pieces as well as interconnecting with other jaws. Ratchet wheel components are embodied in some jaw pieces and connector pieces, and are engageable by the jaws. The connector pieces include pins that interconnect with sockets in the body portions of the jaw pieces. A swivel piece has pivoting arms that each include a socket to interconnect with the connector pieces. A wheel assembly has an axle piece with sockets that also connect to the pins. Also, struts that comprise a series of space apart ratchet wheels, or regular tubular octagonal polyhedrons, have sockets in their ends to engage connector pieces.

40 Claims, 13 Drawing Sheets

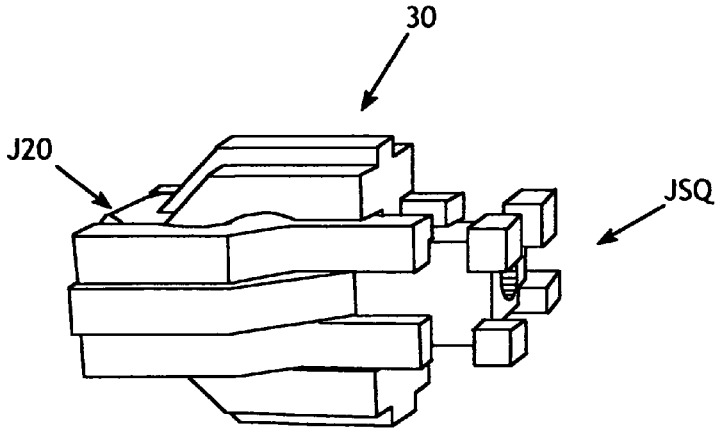
FIG. 8
FIG. 9
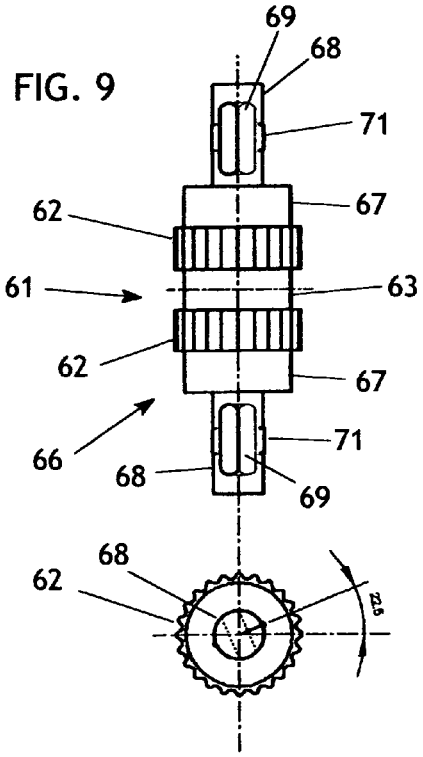
FIG. 10
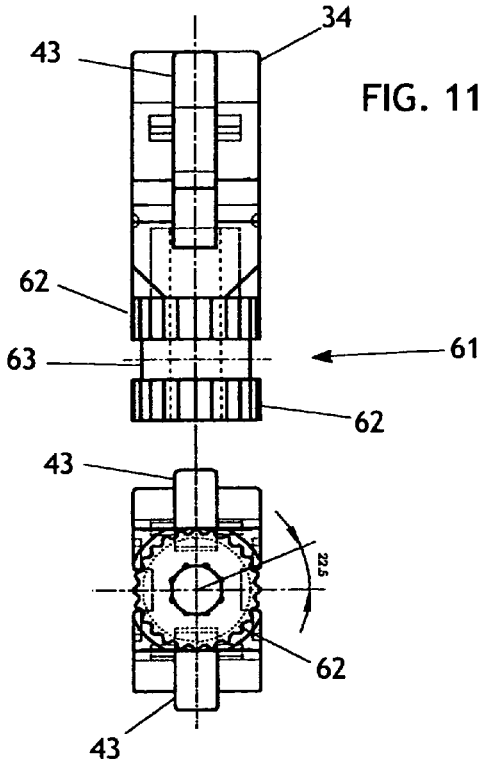
FIG. 11
FIG. 12

FIG. 16
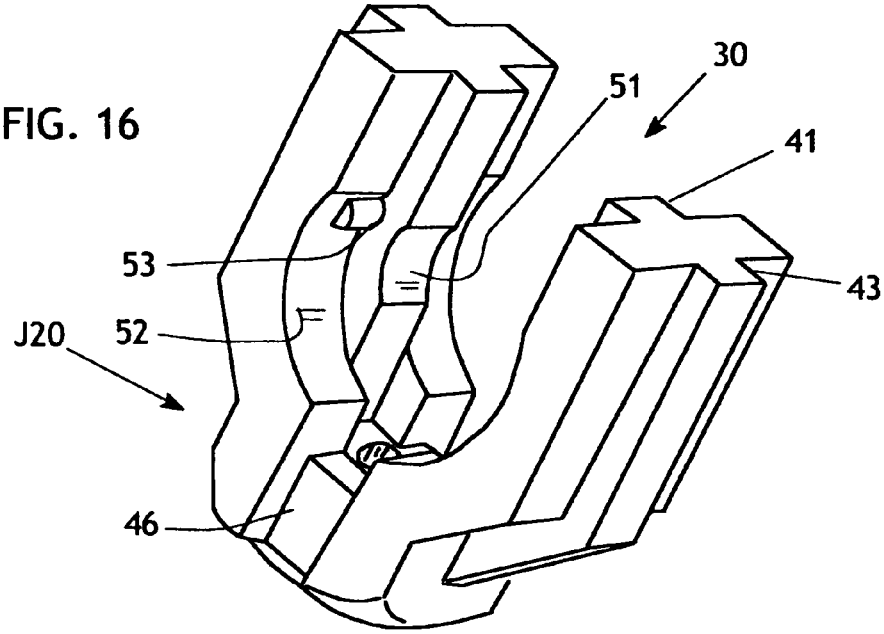
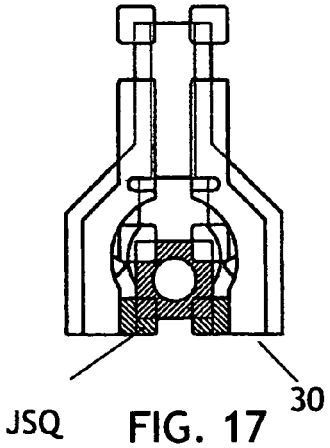
FIG. 17
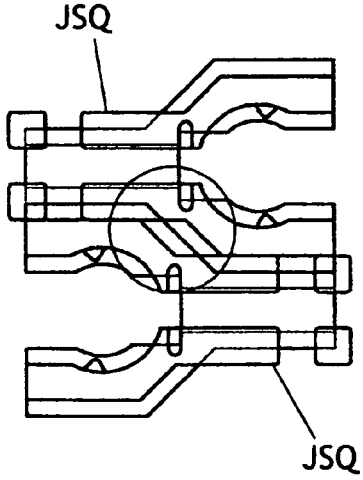
FIG. 18

TOY CONSTRUCTION SYSTEM WITH JAW COMPONENTS

CROSS-REFERENCE TO RELATED APPLICATIONS

Not applicable.

FEDERALLY SPONSORED RESEARCH

Not applicable.

SEQUENCE LISTING, ETC ON CD

Not applicable.

BACKGROUND OF THE INVENTION

1. Field of the Invention

This invention relates to toy construction systems and, more particularly, to construction sets that have a plurality of parts with features that interconnect at various angles.

2. Description of Related Art

Toy construction sets have amused children and many adults for many generations. Generally such toys may be categorized as block sets, or framework, systems. Block sets, such as basic rectangular blocks made of plastic, wood or the like, enable walls to be constructed by merely stacking the blocks, a simple task for young children. Simple vertical structures can be assembled in this way. The addition of interconnection features on the blocks enable stronger, more stable stacks and vertical arrays, but the structures so formed remain fundamentally defined by wall structures. Wall systems are limited in the range of shapes that can be made, and do not enable structures that are not vertically aligned.

Framework systems generally include struts and connectors for joining the ends of the struts at various angles and relationships. The connectors are often hub components having receptacles that receive the strut ends at fixed angular relationships. The progenitor of such toys may be the Tinkertoy™, in which the struts are wooden dowels and the hubs are cylindrical wooden disks having holes to engage the dowel ends. Hub systems tend to enforce a limited number and range of angular connections between the struts, and thus the imagination of the toy builder is not necessarily well-served by these systems.

BRIEF SUMMARY OF THE INVENTION

The present invention generally comprises a toy construction set comprised of components that enable structures of infinite angular possibilities from multiple interconnection features that are engageable in many different and complex ways.

A primary component of the toy construction system is a jaw piece, which is illustrated in three different embodiments. All embodiments include the same jaw construction at one end of the piece: a central body portion having a central opening extending along a central axis, and a pair of spaced apart, diametrically opposed jaw members extending from the central body portion. Each jaw member includes an oblique portion that extends outwardly from the central portion and supports an outer portion extending parallel to the axis and spaced apart therefrom. The confronting surfaces of the jaws are each provided with a rectangular inner rail extending parallel to and projecting toward the axis, each rail occupying approx the central. one-third of the confronting surface area of the jaw. Likewise, the outer surfaces of jaws are also each provided with a similar rectangular outer rail extending parallel to and projecting outwardly from the axis, the outer rail extending along the oblique portion as well as the outer portion of each jaw.

A first pair of channels are formed in the central body portion in diametrically opposed fashion and extending between the opposed jaw pieces. The first channels are dimensioned and spaced apart to receive the inner rails of another such piece and retain the rail in a releasable, frictional fit. Thus, for example, two jaw pieces may be slidably engaged with the jaw openings in mutual mating engagement at 90° opposition, and the confronting inner rails of each piece will engage the pair of first channels of the other piece in mutual fashion. In any case, the opposed inner rails act as a guide for square end of an identical or similar second piece to be slid into the jaw opening.

In addition, medial portions of the confronting surfaces of each jaw piece are each provided with a concave curvature that confronts the other jaw, thereby defining a concave jaw spacing that is slightly greater in separation that the more distal portions of the confronting jaw surfaces. In addition, the two opposed inner rails of the two jaws each have a concave recess in their confronting surface, the concave recess being shallower than the curvature of the opposed jaw surfaces. Furthermore, each jaw is provided with a pair of detent lugs protruding from the confronting surface and disposed at either side of the inner rail thereof, the detent lugs being positioned slightly distally of the middle of the concave recess of the respective rail. The function and significance of these features will be described below.

The various embodiments of the jaw piece differ from the first embodiment described above in the proximal end of the central body portion that is axially opposite the jaw configuration. In a second embodiment the proximal end is elongated, and includes rectangularly arranged sides extending longitudinally. On two opposed sides the first pair of channels is extended to the proximal end. In addition, a second pair of channels is provided, extending longitudinally and medially in the sides. Furthermore, a third set of channels is provided, each extending in one of the rectangular sides and disposed adjacent to the proximal end thereof, each of the third channels extending orthogonally to the axis of the piece and spaced apart therefrom. All of these channels are dimensioned and spaced apart to be mutually engageable with a pair of confronting inner rails of another jaw piece. Thus not only may the two jaw ends may be mutually engaged as explained above, but the jaw end of one piece may be engaged with the body (proximal) end of another jaw piece. This latter engagement may be arranged in many different angular relationships.

In a third embodiment of the jaw piece the central body portion is provided at its proximal end with a pair of ratchet wheels axially spaced and fixedly secured thereto. Each ratchet wheel is comprised of an annulus, having preferably 24 rounded teeth arrayed thereabout and spaced at equal angles. The diameter of each ratchet wheel is substantially the same as the spacing of the confronting inner surfaces of a jaw opening. The two ratchet wheels are separated axially by an annular land that is dimensioned so that its diameter is substantially equal to the spacing of the confronting surfaces of the inner rails of a jaw piece. (The annular land is dimensioned to form an interference fit between the jaw rails, and the jaws undergo sufficient flexure to receive the annular land therebetween in a resilient fit that is easily engaged and released by manual effort.)

The ratchet wheels may be provided in large plurality along the length of a strut piece that is also a component of the invention. Likewise, a pentagonal ratchet piece is comprised of five rods joined end-to-end in pentagonal form, with a ratchet wheel secured medially on each rod, to form a hub for interconnections to other assemblies.

The ratchet wheels are dimensioned to interact with structural features of the jaw piece in unique and interesting ways. First, when the annular land of a ratchet wheel assembly is inserted in a jaw opening, the land slides along the inner rail surfaces, which are resiliently diverged by the interference fit of the land in the jaw. At the same time the two ratchet wheel adjacent to the land are slidably received between the confronting jaw surfaces in close fit. When the land encounters the concave recesses of the opposed inner rails of the jaw piece, which are spaced apart to accommodate the land in a close fit, the land snaps into engagement in the concave recesses. In this position the ratchet wheels are retained by the jaw and are free to rotate at any angle about their axis.

When the ratchet wheel assembly is urged further into the jaw, the teeth of the ratchet wheel come into contact with the detent lugs of the jaw, and resilient flexure of the jaws enable the wheels to pass through the opposed detent lugs. At this position the ratchet wheels encounter the concave curvatures of the jaws, which are dimensioned to accommodate the outer periphery of the ratchet wheels in close fit. Thus the ratchet wheels are snap engaged in the deepest recesses of the jaws. In addition, the detent lugs, which are each received in shallow engagement between two adjacent teeth of the ratchet wheels, are capable of resiliently deforming to permit the ratchet wheels to be rotated from one toothed engagement to the next, whereby the ratchet wheels may be rotated in 15° increments (360°/24 teeth=15° for each tooth). Thus any assembly connected to the ratchet wheels may be rotated through 15°, 30°, 45°, etc., which are the most commonly used angles in toy constructions.

All of the jaw pieces have a central socket which runs lengthwise through the center of the piece. The proximal portion of the aperture is octagonally shaped, with 8 grooves running parallel to the axis from the proximal end for a portion of the length of the aperture. The purpose of the grooves is to accommodate and mate with the pins of the connectors described below.

A further component of the toy construction set is a connector piece that is adapted primarily to engage the central socket of two differing jaw pieces. The connector piece is comprised of a cylindrical body having a pair of annular flanges extending radially outwardly from opposed ends thereof to define therebetween a reduced diameter annular land that is substantially the same dimensions as the annular land of the ratchet wheel assembly. A pair of pins extend axially from opposite ends of the cylindrical body. Each pin includes a slot extending diametrically therethrough to provide resilient compressibility, and a pair of rib-like protrusions extending longitudinally and oriented approximately 90° from the slot openings.

The protrusions are dimensioned to mate with grooves of the holes on all types of pieces and when the pieces are rotated with respect to each other the pins contract and expand to snap back into position in any groove. This flexure allows for eight distinctly different positions when three pieces (two jaw pieces and one connector) are assembled in a tandem formation. The slot inside the pin also allows for self-adjusting fit to insure that all pieces achieve a desired tight fit when assembled.

Another component of the toy construction set is a swivel piece adapted to connect to two jaw pieces or two pin connector pieces. The swivel piece is comprised of three parts: two arms and a swivel pin. One arm includes a rectangular body and a clevis extending from one end thereof, the other arm includes a rectangular body and a ring extending from one end. The ring is received within the clevis and the swivel pin extends through the clevis and ring to join them in variable angular relationship. The swivel piece is unique in that the arms of the swivel can be rotated and locked into various positions also in 15° increments. The expansion ring of the interior of the swivel has a minimum of 6 humps, three on each side of the interior of the ring, which engage the 24 grooves of the center core of the swivel. This insures that a desired position of the arms of the swivel can be maintained even when holding the considerable weight of many assembled pieces. When the arms of the swivel are moved to another angle or desired position, the center ring which has an opening at one end to allow for expansion, opens enough to allow the interior humps to pass over the humps or grooves of the center core to then lock the center core in a new position.

In addition, the swivel has four octagonal holes, one on either end and one on either side, through the center of the core (swivel axis of rotation) to accommodate or receive as many as four pins or connectors. Thus the swivels can be adjusted to any angle, at 15° increments, even when four pieces are attached. The swivel arms impinge at 45°, thus there is a 315° arc or swing of the two arms.

In summary, the basic elements of the construction system are three jaw pieces, ratchet pieces of various lengths and shapes (such as linear and pentagonal), connector pins with unique contraction and locking features, swivels with unique expansion ring and interior humps which insure feel and locking positions, wheels and associated axles that have connector pin features, and octagonal struts. All pieces, except the connectors and pentagonal ratchets have the same octagonally shaped holes with linear grooves which mate with and allow for definite locking and positioning with the connector pins. The combination of these various pieces joined together into an infinite number of construction possibilities makes for a truly unique construction toy.

BRIEF DESCRIPTION OF THE DRAWING

FIG. 8 is a perspective view of a J20 jaw piece secured in handshake fashion fashion in the jaws of a JSQ jaw piece.

FIGS. 9 and 10 are a plan layout view and end elevation of one connector embodiment of the toy construction set of the invention.

FIGS. 11 and 12 are a side view and end view of the JR jaw piece of the toy construction set of the invention.

FIG. 16 is a perspective view of a J20 jaw piece of the toy construction set of the invention.

FIGS. 17-18 are schematic views showing some possible interconnections between the pieces of the toy construction set of the invention.

DETAILED DESCRIPTION OF THE INVENTION

Figure 1:
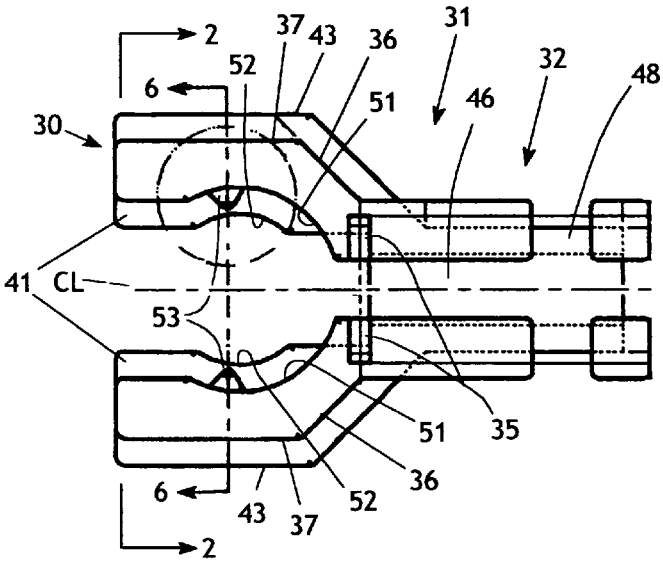
FIG. 1 is a plan layout of a JSQ jaw piece of the toy construction set of the invention.
Figure 2:
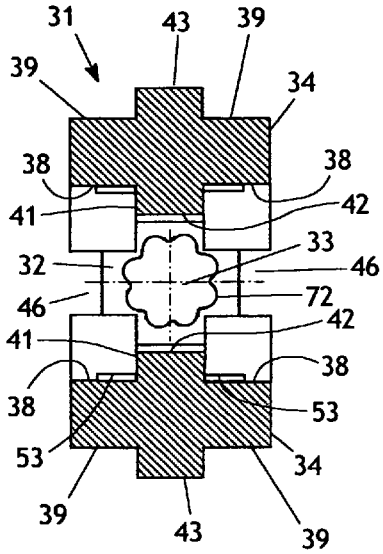
FIG. 2 is a cross-sectional view of the JSQ jaw piece, taken along line 2-2 of FIG. 1.
Figure 3:
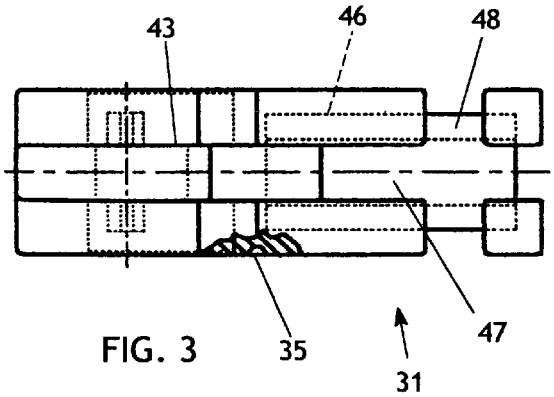
FIG. 3 is a side elevation of the JSQ jaw piece shown in FIGS. 1 and 2.
Figure 4:
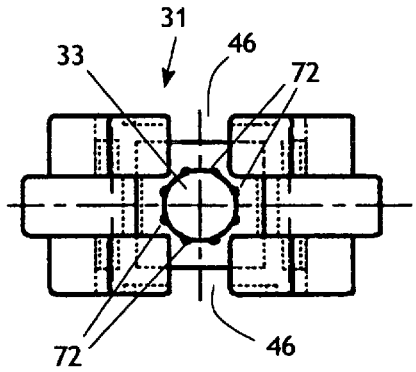
FIG. 4 is an end elevation of the JSQ jaw piece shown in FIGS. 1-3.
Figure 5:
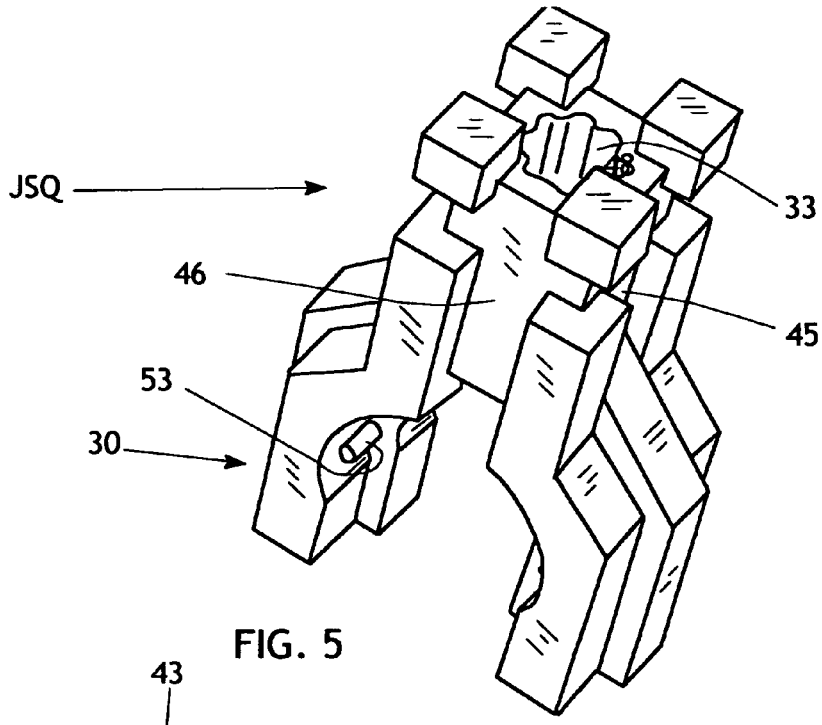
FIG. 5 is a perspective view of the JSQ piece shown in FIGS. 1-4.
Figure 6:
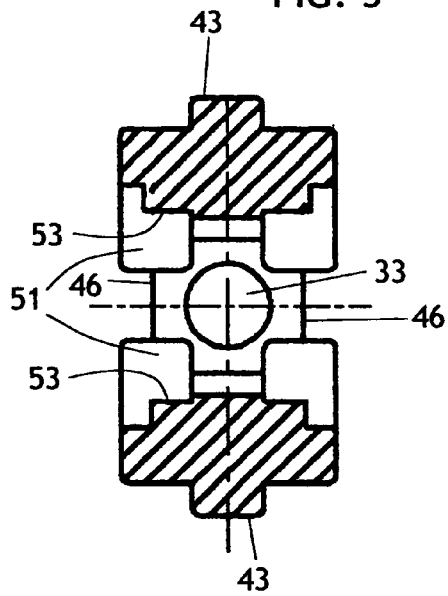
FIG. 6 is a cross-sectional view of the JSQ piece, taken along line 6-6 of FIG. 1.

The present invention generally comprises a toy construction set that provides amusement and challenging spatial geometries due to its many modes of connections and angular possibilities, using only a few basic pieces.

With regard to FIGS. 1-6, a basic component of the toy construction set is a jaw piece 31. The jaw piece is supplied in three different embodiments, all of which include the same jaw construction 30 at one end of the piece. There are three jaw type pieces referred to as 1) JR (jaw with ratchet) shown in FIG. 15; 2) JSQ (jaw with square end) shown in FIG. 5 and, 3) J20 (jaw only, without a ratchet or a square end) shown in FIG. 16. In FIGS. 1-5 the jaw piece 31 is a JSQ (jaw with square end) style. The jaw construction 30 includes a central body portion 32 having a generally rectangular configuration extending longitudinally along an axis of symmetry CL. The four rectangle sides are generally equal in length and width. The central body portion 32 includes a central socket 33 extending along the axis CL, and a pair of spaced apart, diametrically opposed jaw members 34 extending from the central body portion. Each jaw member is comprised of an oblique segment 36 extending outwardly from the central body portion 32, and an outer segment 37 supported at the end of the oblique segment. The jaws and central body portion may be integrally formed of a suitable plastic, resin, or polymer material that is strong, resilient, and capable of injection molding or the like production process.

The jaws 34 have confronting jaw surfaces 38 and outer jaw surfaces 39. An inner rail 41 protrudes inwardly from confronting jaw surface 38 and extends parallel to the axis CL. The inner rail 41 has a rectangular cross-sectional configuration, and occupies approximately the medial one-third of the width of the confronting surface 38. The inner rails have confronting surfaces 42 in parallel, space apart disposition. In addition, an outer rail 43 protrudes outwardly from outer jaw surface 39 parallel to the axis CL, and likewise occupies approximately the medial one-third of the width of the outer surface 39. The outer rail 43 has the same rectangular configuration as the inner rail 41. The outer rail 43 extends from the oblique segment 36 as well as the outer segment 37 of each jaw.

Figure 7:
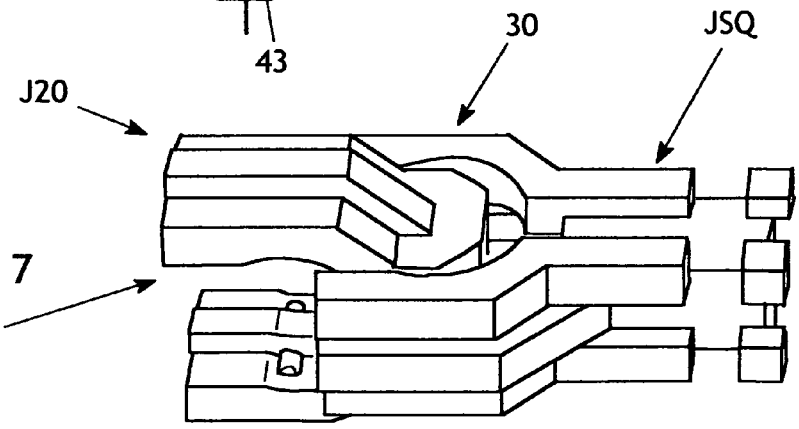
FIG. 7 is a perspective view of a J20 jaw piece secured in chain fashion in the jaws of a JSQ jaw piece.

All jaw pieces also include a first pair of channels 46 formed in the central body portion in diametrically opposed fashion and extending in a plane that bisects the jaw opening of the piece. A primary characteristic of the channels 46 is that they are dimensioned and spaced apart to receive the inner rails 41 of any other jaw piece in fashion in a close tolerance, complementary fit and retain the rails 41 in a releasable, frictional manner. Thus, for example, the jaws of one piece may be engaged in the channels 46 of another such piece to link in a serial chain effect, as shown in FIG. 7, where the channels 46 of a J20 piece are engaged by the jaws of a JSQ piece. Alternatively, two jaw pieces may be slidably engaged with the jaw openings in mutual mating engagement at 90° opposition in a "handshake", and the confronting inner rails of each piece will engage the pair of first channels 46 of the other piece in mutual fashion, as shown in FIG. 8.

The jaws include further enhancements for engaging the other components of the construction set. Both confronting surfaces 38 of each jaw 34 are provided with a concave curved portion 51 disposed in enantiomorphic relationship to the opposed jaw of the pair. Thus confronting curved portions 51 define a jaw spacing that is slightly greater than the more distal portions of surfaces 38, as shown particularly in FIGS. 1 and 5. In addition, the two opposed inner rails 41 of the two jaws 34 each have a concave recess 52 in their confronting surfaces 42, the concave recess 52 being shallower than the recess 51. Indeed, the curved surfaces 51 and 52 are arc sections (of differing length) of two concentric circles that are centered on axis CL.

Furthermore, each jaw 34 is provided with a pair of rib-like detent lugs 53 protruding from the concave surface 51 and disposed at either side of the inner rail thereof 41, the detent lugs being positioned slightly distally of the middle of the concave recesses of the respective rail 41 and oriented transverse to the axis CL. Note that the lugs 53 extend into the jaw opening inwardly of the adjacent surfaces 38, and thus form an obstacle to any object slidably translating along the surfaces 38, for purposes to be explained below. Note also that a pair of detent grooves 35 are provided on each top and bottom face of the jaw 30, each groove 35 extending transverse to the axis CL and disposed at the root of the oblique portion 36 of each jaw member 34. When two jaw pieces are engaged handshake fashion as shown in FIG. 8, the detent lugs 53 of each jaw snap-engage the detent groove 35 of the other mated piece to retain the connection of the two pieces.

A further fundamental assembly of the toy construction set is a ratchet wheel assembly 61, as shown in FIGS. 9-12. Each ratchet wheel assembly 61 is comprised of a pair of ratchet wheels 62, which includes an annulus having a plurality of rounded teeth arrayed thereabout and spaced at equal angles. Each rounded tooth is adjacent to a rounded root, so that the surface undulates smoothly with no edges or crevices. In the preferred embodiment there are 24 teeth about the cylindrical periphery, so that the teeth are spaced at 15° increments. The two ratchet wheels are spaced apart axially by an annular land 63 having an axial width substantially equal to the width of a rail 41 or 43. Indeed, the axial width of each ratchet wheel is substantially the same as the width of the confronting jaw surfaces 38. Furthermore, the diameter of each ratchet wheel is slightly less than the diameter of the confronting curved surfaces 51 of the jaw assembly. The diameter of the annular land 63 is substantially equal to the spacing of the confronting surfaces 42 of the inner rails 41 of each jaw. The annular land 62 is dimensioned to form an interference fit between the jaw rail surfaces 42, and the jaws may undergo sufficient outward flexure to receive the annular land 62 therebetween in a resilient fit that is easily engaged and released by manual effort.

A key aspect of the toy construction set is the mechanical connections that are enabled by the jaw assembly and the ratchet wheel assembly. To connect a jaw assembly 30 to a ratchet wheel assembly 61 of another piece, the annular land 63 of a ratchet wheel assembly is inserted in a jaw opening, the land 63 slides along the inner rail surfaces 42, which are resiliently diverged by the interference fit of the land 63 in the opening between surfaces 42. At the same time the two ratchet wheels 62 adjacent to the land 63 are received between the confronting jaw surfaces 38 in close fit, freely translating fashion. When the land 63 encounters the concave recessed surfaces 52 of the opposed inner rails of the jaw piece, which are spaced apart to accommodate the land 63 in a close fit, the land snaps into engagement in the concave recesses. At the same time, the teeth of the ratchet wheels 62 come into contact with the detent lugs 53 of the jaw (FIG. 13), and resilient flexure of the jaws enable the detent lugs to snap into engagement between two adjacent teeth of each ratchet wheel. This engagement is sufficiently strong to be maintained indefinitely.

Figure 14:
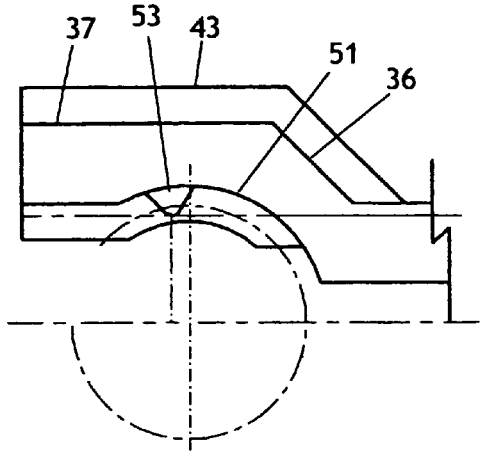
FIG. 14 is an enlarged schematic view of the detent lug of each jaw member.

With further movement of the ratchet wheels into the jaw, the ratchet wheels encounter the concave curved surfaces 51 of the jaws, which are dimensioned to accommodate the outer periphery of the ratchet wheels in close fit. The ratchet wheels pass through an over-center position (FIG. 14) and then snap-engage in the deepest recesses of the jaws. In addition, the detent lugs, which are each received in shallow engagement between two adjacent teeth of the ratchet wheels, are capable of resiliently deforming to permit the ratchet wheels to be rotated from one toothed engagement to the next, whereby the ratchet wheels may be rotated in 15° increments (360°/24 teeth=15° for each tooth). Thus any assembly connected to the ratchet wheels may be rotated through 15°, 30°, 45°, etc., which are the most commonly used angles in toy constructions.

Figure 15:
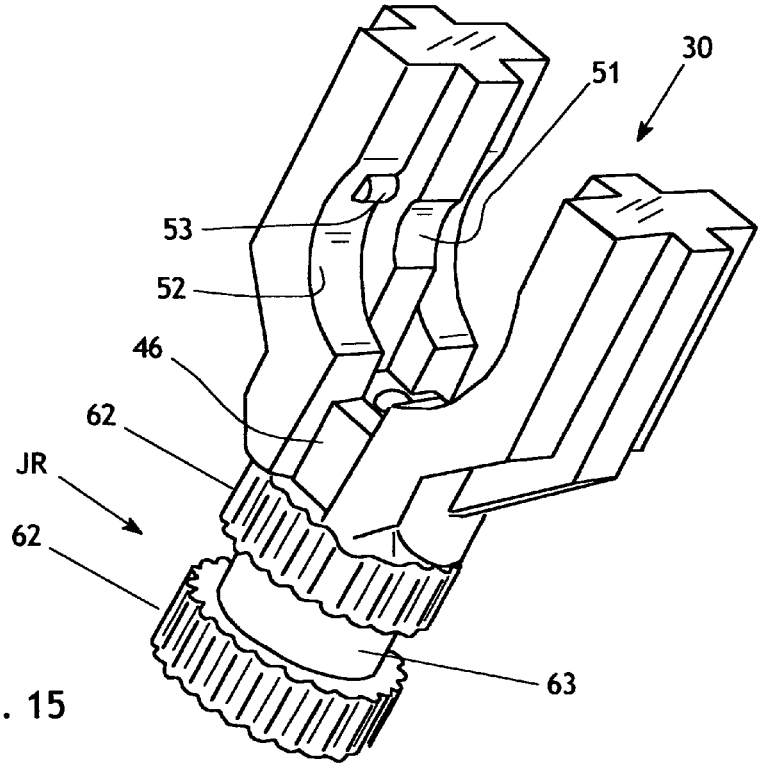
FIG. 15 is a perspective view of a JR jaw piece of the toy construction set of the invention.

The ratchet wheel assembly 61 is a constituent of the JR piece of the toy construction set, as shown in FIGS. 11, 12, and 15. The ratchet wheel assembly extends coaxially with the axis CL, and the passage 33 extends entirely through the ratchet wheel portion as well as the central body portion 32. In addition, the ratchet wheel assembly 61 is embodied in the ratchet connector piece 66 shown in FIGS. 9 and 10. Connector piece 66 includes, in addition to the assembly 61 described above, a pair of annular lands 67 substantially the same as land 63 and disposed coaxially therewith. The lands 67 extend integrally from the ends of assembly 61, and a pair of connector pins 68 extend axially from the end surfaces of the lands 67. Each pin 68 is provided with a slot 69 extending diametrically through a medial portion thereof. In addition, a pair of rib-like protrusions 71 extend radially outwardly from the pin surface, and are in diametrical opposition at positions 90° from the openings of the slot 69.

The connector pins 68 are configured to be engaged in the central socket 33 of the jaw pieces and any other pieces provided with a similar opening. The central socket 33 is configured to engage the pins 68 in complementary fit and is provided with eight grooves 72 extending longitudinally in the interior bore surface along the vertices of the octagonal hole to define a rounded rib extending longitudinally along each interior octagonal facet (see FIGS. 2, 4, 26, 32, and 33 for example). The protrusions 71 of the pins 68 are dimensioned to snap-engage any of the grooves 72, and the slot 69 allows the pin to contract elastically and enable the protrusions to flex inwardly and ride over the humps between the grooves. Thus the pin connections can be "indexed" through 45° increments (360°/8 grooves) so that any object connected to the pin can extend at these angular increments.

The connector pieces 66 may be used to connect together any two jaw pieces in axial alignment, each pin 68 engaged in the aperture 33 of one of the jaw pieces. The jaws may be oriented at any indexed angular orientation and maintained at that angle by the protrusions 68 snap-fit in grooves 72. The jaws of pieces thus connected may be used to connect to the central body portions of other pieces (by rails 41 engaging in channels 26 of adjacent pieces), other ratchet assemblies of other pieces (by inserting land 62 between rails 41), and other possibilities described below, and form a portion of a large, diverse, angularly complex toy construction (see FIGS. 27 and 32).

Figure 34:
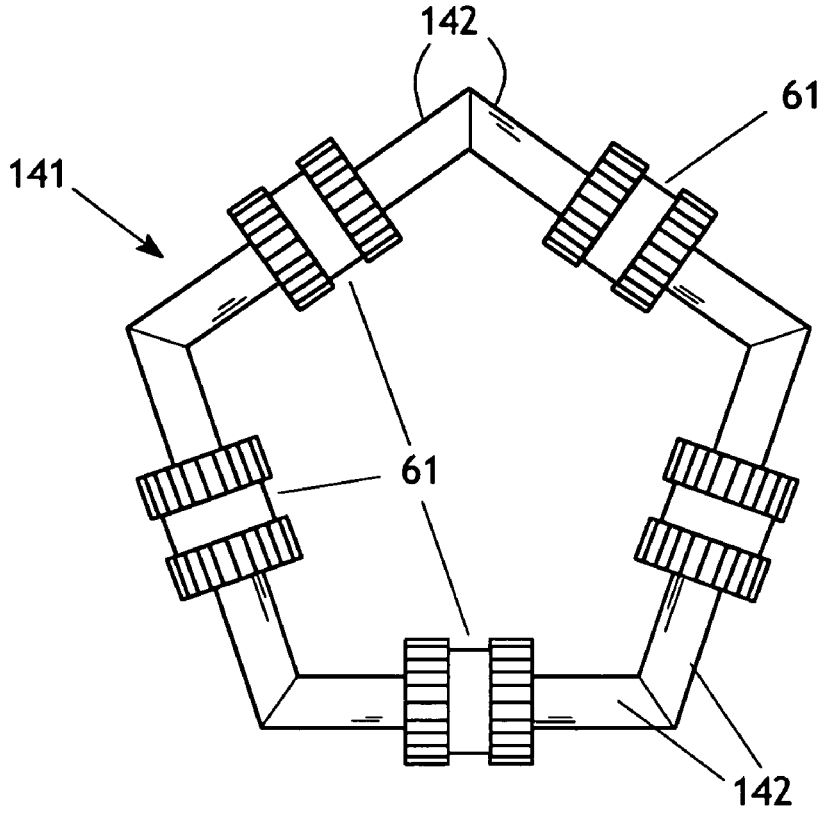
FIG. 34 is a plan view of a pentagonal ratchet piece of the toy construction set.

With reference to FIG. 34, the ratchet wheel feature is also incorporated in pentagonal ratchet piece 141, which is comprised of five rods 142 joined end-to-end in a regular pentagonal form. A ratchet wheel assembly 61 is disposed medially in each rod 142, whereby any other piece capable of engaging a ratchet wheel may connect with any side of piece 141. Thus the pentagonal ratchet piece may serve as a hub to connect many sub-assemblies which diverge therefrom at the pentagonal angles (360°/5=72° increments). Note also that components joined to the ratchet wheels of piece 141 may extend at any of the indexed angles (45° increments) from the respective ratchet wheel, thus enabling many complex angular relationships among the assemblies joined to the piece 141.

Figure 35:
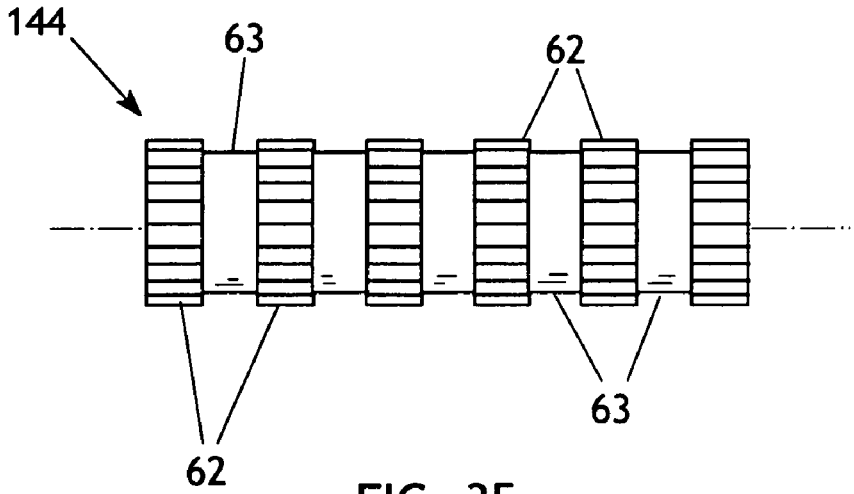
FIG. 35 is a plan view of a linear ratchet piece of the toy construction set.

With regard to FIG. 35, the ratchet wheel is also embodied in linear ratchet piece 144. A plurality of ratchet wheels 62 are disposed in stacked, spaced apart fashion along an axis, each two adjacent ratchet wheels 62 being spaced by an annular land 63, as described previously. Each pair of adjacent ratchet wheels enables a connection to a jaw piece, as described previously, so that multiple connections to jaw pieces may be constructed on the linear ratchet piece, each at its own indexed angle with respect to the axis of the piece 144.

Returning to the JSQ jaw piece 31 of FIGS. 1-6, the central body portion 32 is provided with another set of channels 45 extending longitudinally along opposed sides of the rectangular central body. The channels 45 are formed substantially the same as channels 46 (in, width, depth and longitudinal alignment) but are foreshortened by the presence of the outer rails 43 which arise obliquely from the floor of each channel 45. Likewise, a further set of channels 48 extend in each of the rectangular sides of the central body portion spaced closely to the proximal end and oriented orthogonally to the axis of the piece. (Note that the channels 45 and 48 are not provided on jaw pieces JR or J20.) The channels 48 are also substantially similar to channels 45 and 46 in width and depth. Thus any jaw piece may engage the channels 45 or 46 of another piece 31 to connect with the jaws of the two piece either parallel or orthogonally offset along the same axis. Likewise, the jaws of one piece 31 may engage the channels 48 of another such piece to make a connection in which the jaws of the two pieces are offset on differing axes.

Figure 13:
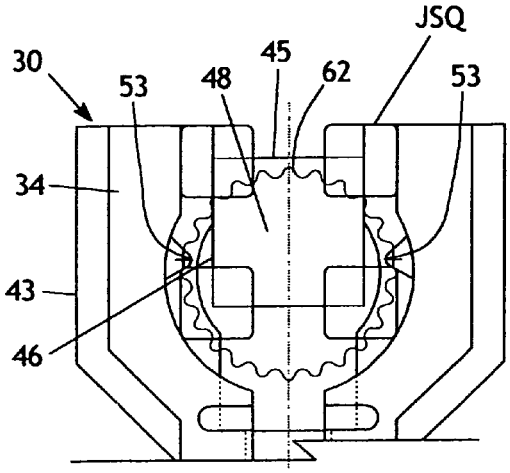
FIG. 13 is a schematic view depicting the engagement of a jaw assembly with a ratchet assembly and with a body portion of a JSQ jaw piece.

Note that when the channels 45, 46, or 48 of a JSQ piece are engaged by inner rails 41 of a jaw assembly 30 (of any jaw piece type), the proximal end of the piece is fully inserted into the jaw opening. As shown in FIGS. 13 and 17, the protrusions 53, which extend slightly into the jaw opening, are forced apart resiliently to allow passage of the proximal end. The protrusions 53 then snap-engage into the channel openings 46 (or 45, if the piece is rotated 90° about its axis), impinging on the sidewall of the channel, to retain the body portion of a JSQ piece. This engagement is sufficiently strong to be self-maintaining even if heavy structures are cantilevered from the jaws of the JSQ piece.

An additional connection may be made between the end of any jaw member 34, which has a cross-like end configuration, and the intersection of any channel 48 with a channel 45 or 46 on the body of a JSQ piece. The cross-like end is a complementary interference fit in the channels at the intersection, so that any JSQ body may be joined to the end of a jaw member 34. Another fascinating connection may be made as shown in FIG. 18, in which two JSQ pieces are aligned side-by-side and reversed end-to-end so that the oblique portions of the outer surfaces of the jaw members 34 are disposed at complementary angles. The outer rails 43 of each piece are received in the channels 45 of the other piece, and the two pieces are bound in a perfect, flush fit.

Figure 19:
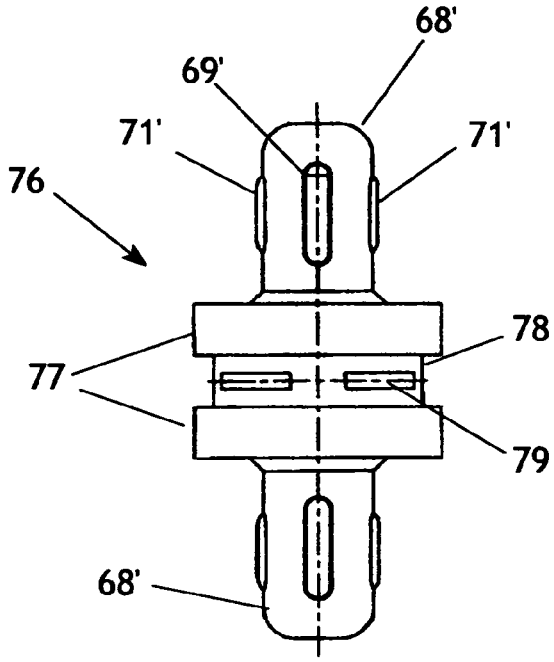
FIGS. 19-21 are a plan layout, end elevation, and perspective view of another connector piece of the invention.
Figure 21:
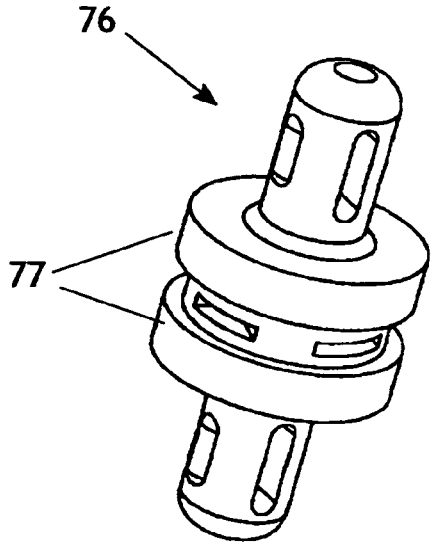
Figure 20:
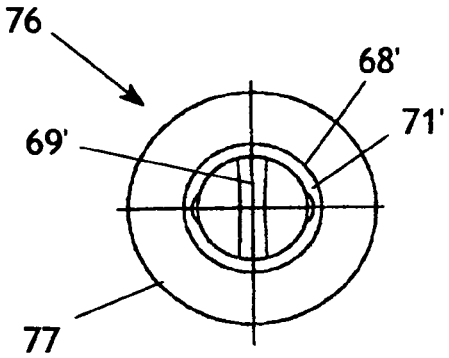

The toy construction set of the invention further includes other connector pieces similar in some features to the connector 66, which are denoted by the same reference numeral with a prime (') designation. With regard to FIGS. 19-21, a connector 76 includes a central body having a generally cylindrical configuration. A pair of flanges 77 extend radially outwardly from the body and have smooth peripheral surfaces. Defined between the flanges 77 is a reduced diameter annulus 78 having a diameter substantially equal to the spacing of the jaw inner rail surfaces 42. A quartet of recesses 79 extend into the surface of annulus 78 for stress relief purposes. The diameter of the flanges 77 is slightly less than the spacing of the concave portions 51, so that the flanges may be received within the confronting surfaces 38. The annulus 78 is dimensioned to snap-engage in the confronting concave surfaces 52 of the jaws. Note that in this engagement there is no ratchet engagement, and the connector 76 is free to rotate when engaged in a jaw 30.

The connector 76 includes a pair of connector pins 68' extending axially from opposed ends of the central body. Each pin includes a slot 69' extending diametrically through a medial portion thereof. In addition, a pair of rib-like protrusions 71' extend radially outwardly from the pin surface, and are in diametrical opposition at positions 90° from the openings of the slot 69'. The pins 68' interact and engage the central sockets 33 as described previously. Thus the connector 76 provides all the interconnecting features of connector 66, except for the ratchet indexed angular orientation of the connector in the jaw.

Figure 22:
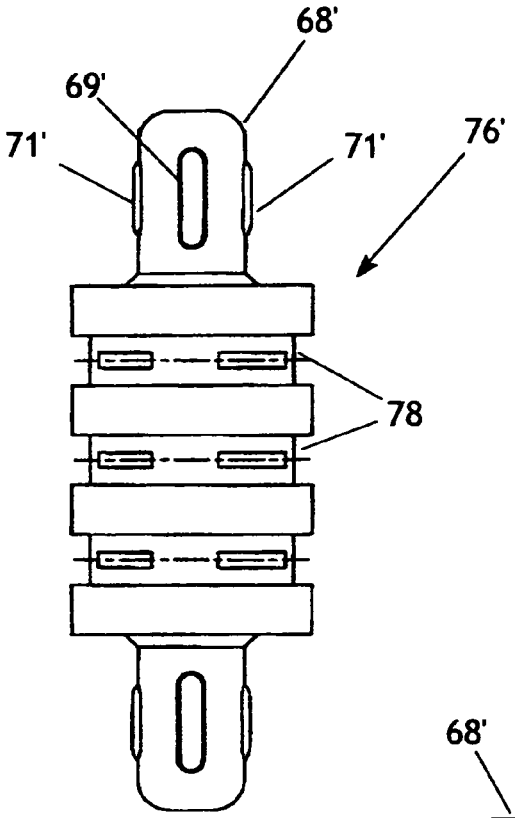
FIGS. 22 and 23 are a plan layout and a perspective view of a further embodiment of a connector piece of the invention.
Figure 23:
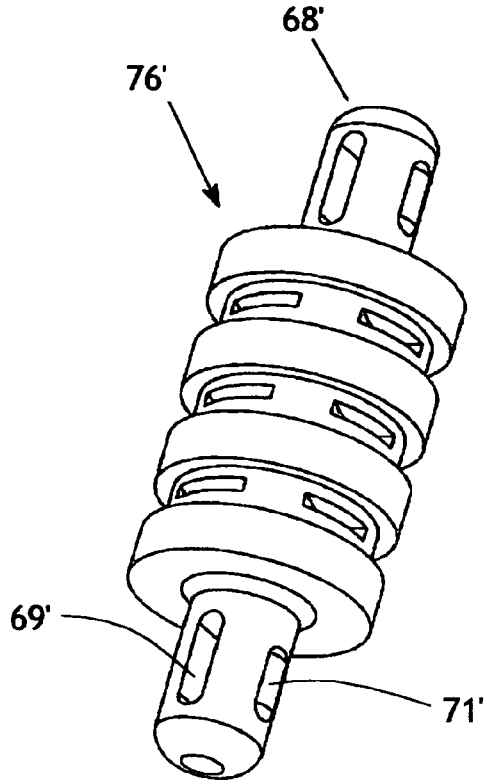

With regard to FIGS. 22 and 23, the connector 76 may be modified in configuration to include more than two flanges 77 to define a plurality of annuli 78. The modified connector 76' is capable of interconnecting using the pins 68', and in addition may engage numerous jaw assemblies 30 for multiple interconnections. An extensive array of flanges 77 on one longitudinally extending piece may comprise a strut for making distant connections.

Figure 24:
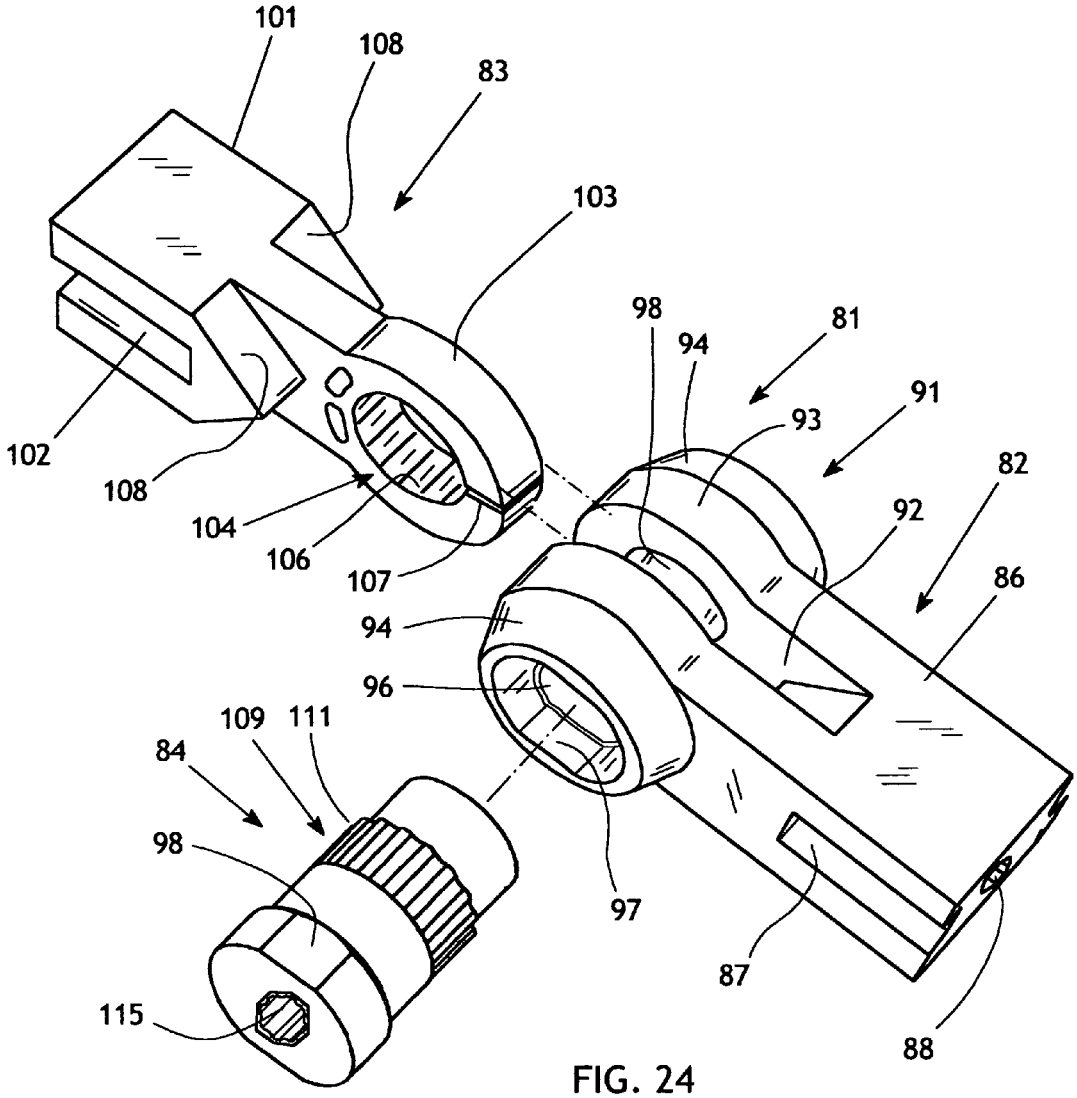
FIG. 24 is an exploded perspective view of the swivel piece of the toy construction set of the invention.

Another component of the toy construction set is a swivel assembly 81, shown in FIG. 24. The swivel assembly 81 is comprised of two arm pieces 82 and 83 and a swivel pin 84. Arm 82 includes a generally rectangular solid body 86 that is provided with channels 87 in opposed sides thereof, the channels 87 being dimensioned and spaced apart to be engageable by the opposed jaw members 34 of a jaw assembly 30 with the inner rails 41 of the jaw being received in the channels 87 in a close tolerance, frictional fit that is self-sustaining but easily releasable by manual effort. In addition, a central socket 88, similar to the central socket 33 of the jaw pieces, extends into the proximal end surface of the body 86. The aperture 88 provides connectability to connectors 66 or 61, and thus to other toy construction pieces, in addition to the jaw connections made possible by the channels 87.

Extending at the distal end of body 86 is a clevis 91 that defines a medial slot 92 extending into the distal end of the body. The ends 93 of the clevis are rounded and blend into truncated conical bosses 94 extending from opposed sides of the clevis 91. Holes 98 are aligned and extend transversely through each of the clevis ends 93 and bosses 94, and are adapted to receive swivel pin 84. Note that one opening 96 of hole 98 includes a pair of flats 97 in diametrical opposition that are disposed to receive complementary flats 99 on the head of the pin 84, as described below.

The arm piece 83 includes a rectangular body 101 that is provided with channels 102 in opposed sides thereof, the channels 102 being dimensioned and spaced apart to be engageable by the opposed jaw members 34 of a jaw assembly 30 with the inner rails 41 of the jaw being received in the channels 102 in a close tolerance, frictional fit that is self-sustaining but easily releasable by manual effort. In addition, a central socket (not shown in FIG. 24), similar to the central sockets 33 and 88, extends into one end of the body 101 to provide the same connectability as described previously. Extending from the other end of the body 101 is a blade-like protrusion 103 having a ring-like shape that is substantially similar to the curvature of the clevis ends 93 and bosses 94. The protrusion 103 is dimensioned in width and diameter to be received in slot 92 in close tolerance fit. An opening 104 extends through the protrusion 103 axially with respect to the ring-like shape, and is provided with an interior bore surface that features a plurality of rounded teeth 106 extending parallel to the hole axis and arrayed serially at equal angles. A planar opening 107 extends radially through the ring to the opening 104, splitting the ring into two equal parts.

The ring portion 103 is adapted to be inserted into slot 92 with the opening 104 disposed coaxially to the holes 98. Swivel pin 84 is inserted through opening 96 and extends therethrough and through the opening 104 and the other hole 98, and is secured by ultrasonic welding or the like. Note that the pin includes a medial annulus 109 that is provided with a plurality of rounded teeth 111 extending longitudinally and spaced thereabout. The annulus 109 is disposed to be received within the opening 104 of the ring 103, and dimensioned so that the teeth 106 interact and engage with the teeth 111 of the pin 88 in complementary fit fashion. The split ring 107 enables the teeth 106 to snap-release the teeth 111 when the two parts are rotated with sufficient force, resulting in an indexed ratchet effect that permits the two parts to be rotated through fixed angular increments; i.e., 15° or the like. Thus any two pieces connected to the body members 82 and 83 may be arranged at any of the indexed angular values and maintained in that disposition.

Figure 25:
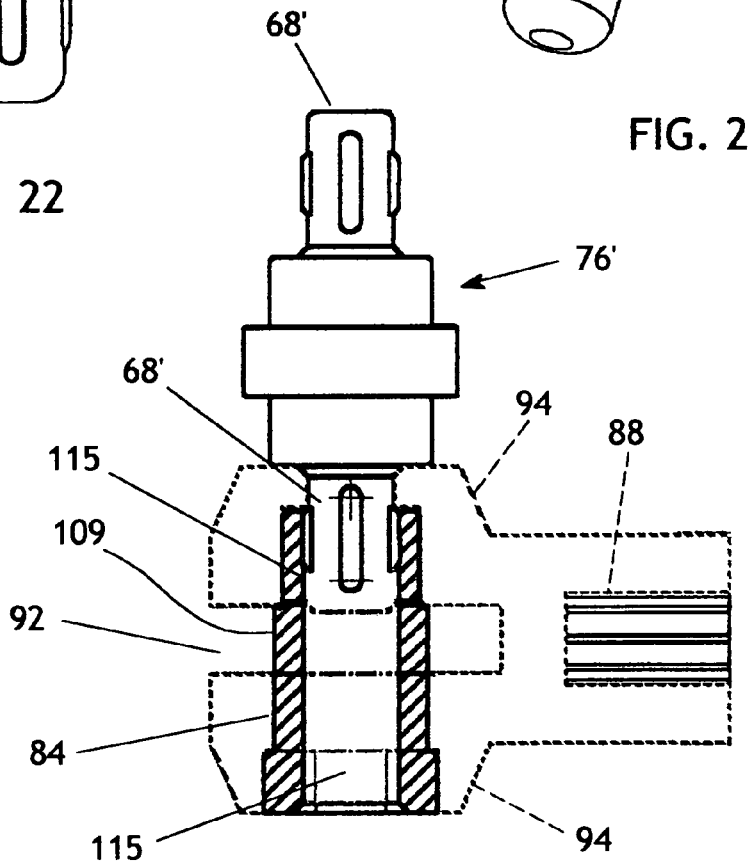
FIG. 25 is a cross-sectional view of the swivel pin installed in a swivel piece as shown in FIG. 24.

In addition, other components may be connected to the swivel pin itself of the swivel connector 81. That is, the swivel pin 84 includes axial holes 115 in opposed ends that are configured substantially the same as apertures 33 and 88 described above, and are thus adapted to receive any of the connector pins 68, 68', or the like. See FIG. 25. By this means any type of piece may be connected at either end of the swivel pin 84, in addition to the other connection possibilities described above.

Figure 26:
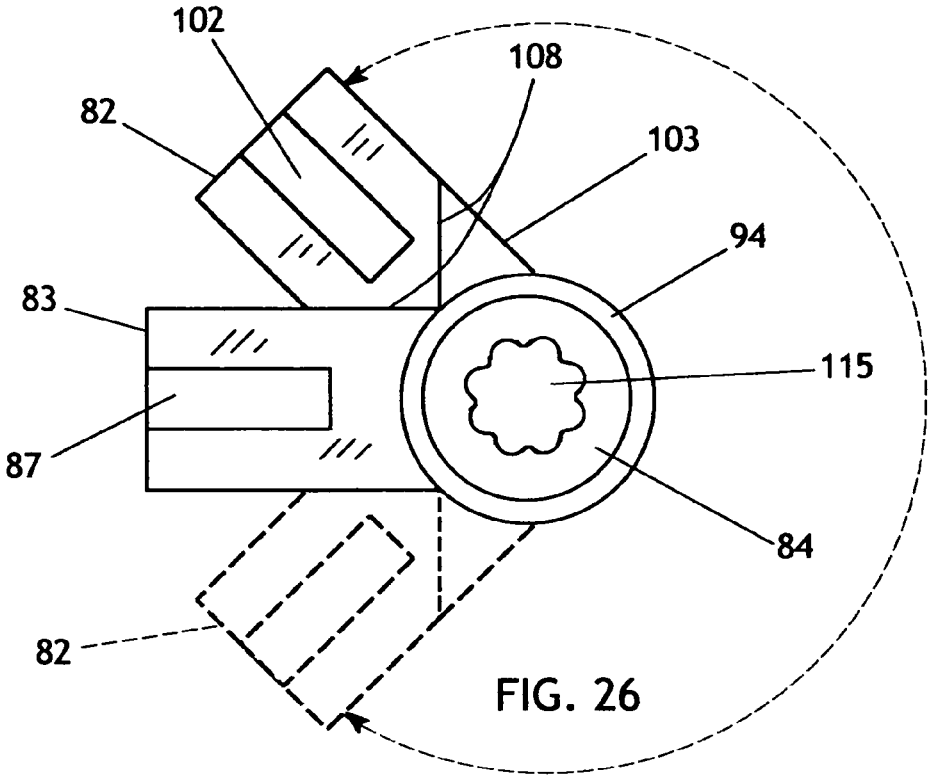
FIG. 26 is a plan view of a swivel piece showing the range of rotation of the swivel arms.

Note that the body member 101 is provided with beveled ends 108 that diverge at approximately 45° from an imaginary central plane through the piece. As shown in FIG. 26, these beveled surfaces enable the two arm members to rotate through a range of 270°.

Figure 30:
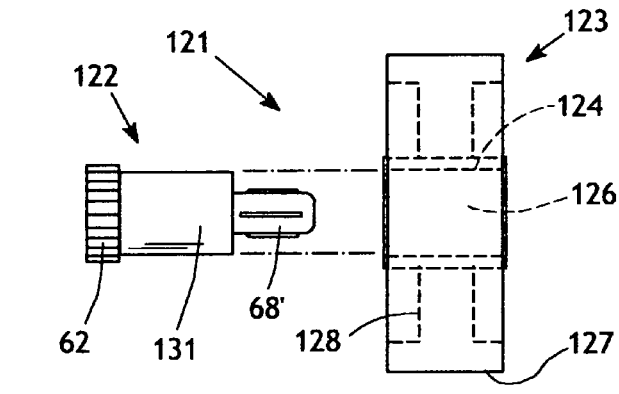
FIG. 30 is an exploded view of the wheel assembly of the toy construction set.
Figure 31:
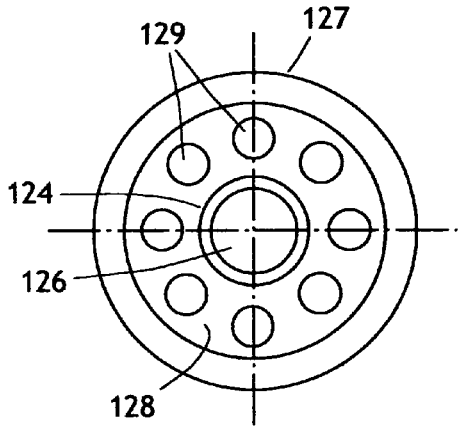
FIG. 31 is a plan view of the wheel itself.
Figure 32:
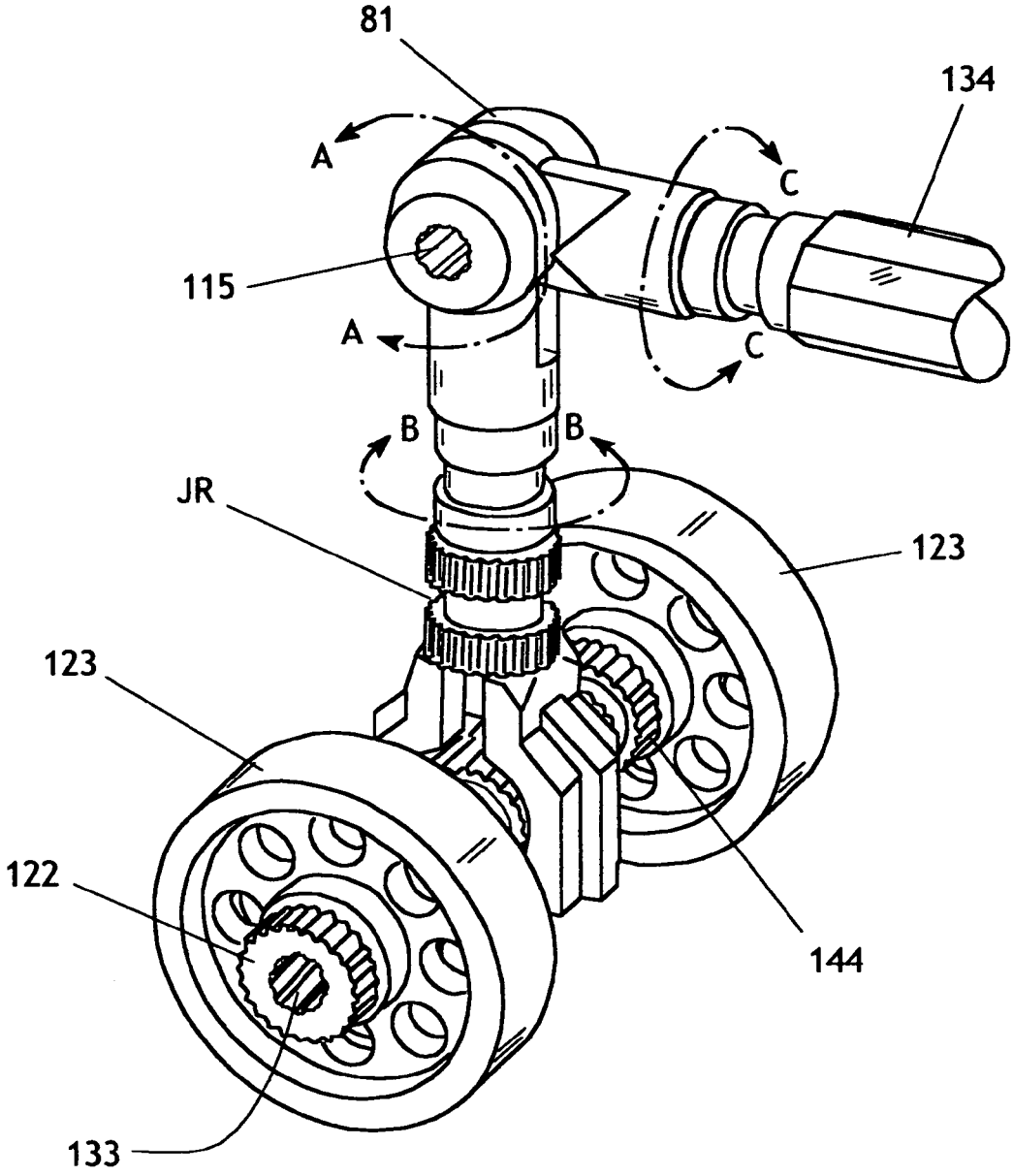
FIG. 32 is a perspective view of another example of an assembly of the toy construction set, including a wheel assemblies and octagonal struts in addition to other components.

With regard to FIGS. 30-32, a further component of the toy construction set is a wheel assembly 121, comprised of an axle 122 and a wheel 123. The wheel 123 includes a hub 124 having a central bore 126, and an outer concentric rim 127 substantially equal in width to the hub 124. A web 128 extends radially to join the hub and rim and is provided with holes 129 to both reduce the amount of casting material and provide enhanced visual interest. The axle 122 includes a medial bushing 131 having a length substantially equal to the depth of bore 126 and a diameter dimensioned to engage in the bore 126 in freely rotating fashion. A connector pin 68' extends axially from one end of the bushing 131, and a ratchet wheel 62 extends coaxially from the other end of the bushing 131. In addition, a central socket 133, similar to the apertures 33, 88 or 115, described previously, extends axially into the end that bears the ratchet wheel 62' to provide connectability with any of the connector pieces described previously.

As shown in FIG. 32, each axle piece 122 extends through the bore 126 of a wheel 123, the diameter of the ratchet wheel being greater than the diameter of the bore 126 to abut the end of the hub 124. The pin 68' of the axle may be received in any aperture 33, 88, or 115 to secure the wheel to another part of the toy construction. In FIG. 32, by way of example, a linear ratchet 144 receives the pins 68' of two wheel assemblies in opposed ends thereof to form a simple wheel truck. Many other wheel mountings are possible, limited only by the imagination of the user and the number of parts available.

Figure 33:
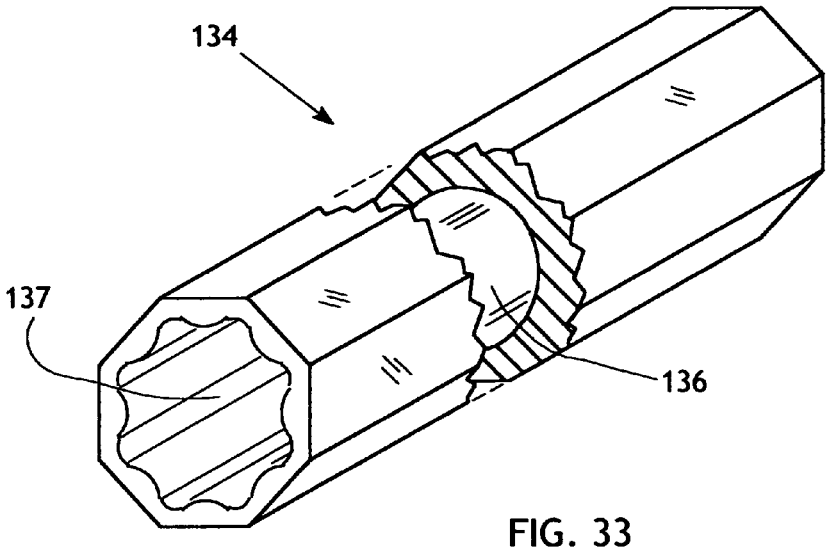
FIG. 33 is a perspective view of the octagonal strut piece of the toy construction set.

An additional component of the toy construction set is a strut 134, shown in FIGS. 32 and 33. Strut 134 is an octagonal regular polyhedron having a length much greater than its width, and is provided to form connections between parts separated by some distance. The strut is tubular, with a central cylindrical bore 136, and each end is provided with a central socket 137 substantially the same as the central sockets 33, 88, 115 or 133. Thus any connector piece described previously may be secured in the central socket 137 to join another component thereto, such as a wheel assembly, a jaw piece, a swivel assembly, and the like. Note that in FIG. 32 a strut 134 is joined by a connector to swivel assembly 81, the other side of which is joined by a connector to a jaw piece JR that is snap-engaged to a midpoint of the linear ratchet 144. This simple connection arrangement provides three orthogonal axes of rotational freedom, associated with the swivel 81, as shown by arcuate arrows A, B, and C.

Note that in all the embodiments described herein all the edges are provided with a fillet or rounded conformation to enable easy insertion and removal of complementarily dimensioned components. The components are shown in the drawings with sharply defined edges to simplify the rendering.

Figure 28:
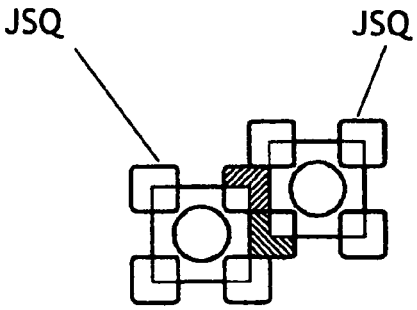
FIGS. 28 and 29 depict further connection possibilities among the pieces of the toy construction set.
Figure 29:
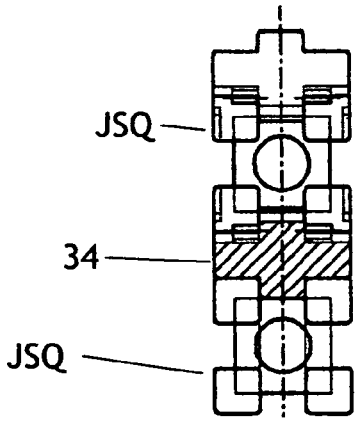
Figure 27:
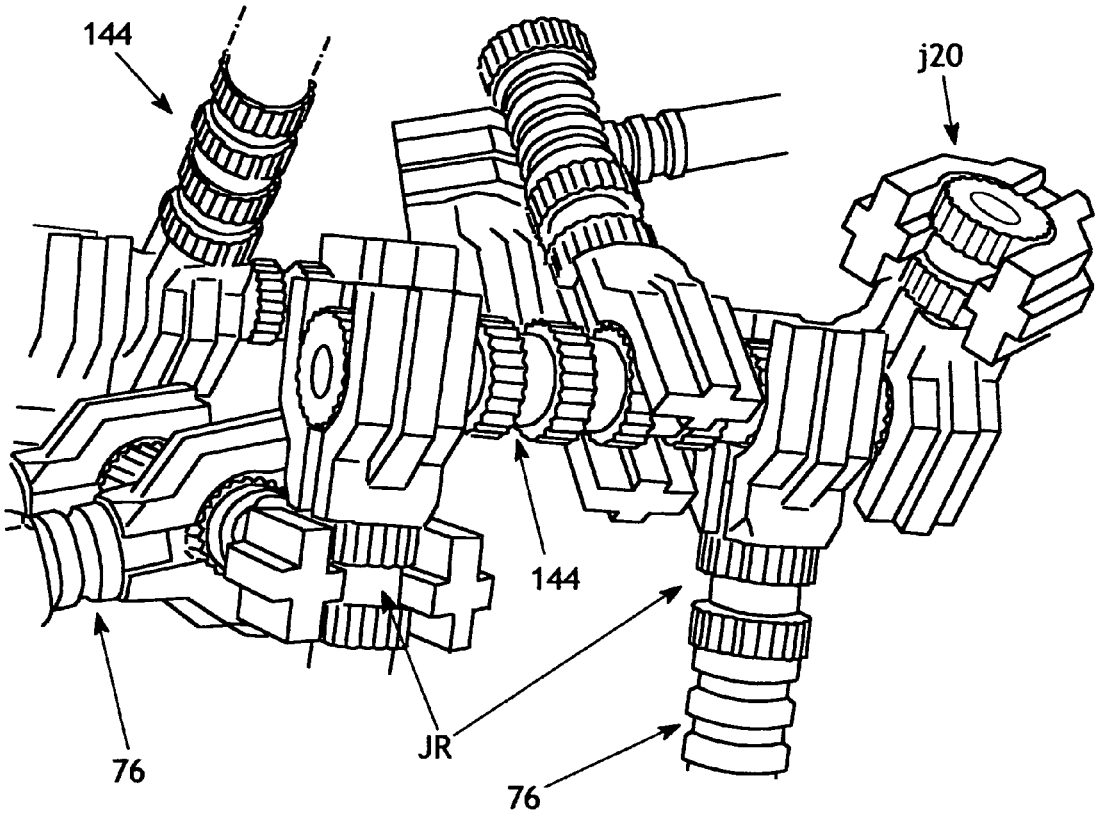
FIG. 27 is a perspective view of an example of an assembly of the pieces of the toy construction set of the invention.

The various pieces and their connection features enable a child or adult to assemble a complex structure that may extend at an infinite range of angles, form and diverge from a wide range of hub structures, and to provide an enjoyable experience for the user. As shown in FIG. 27, various jaw pieces are combined with connectors and linear ratchets 144 to form an interesting and dense structure. Likewise, some other non-obvious connections are, as shown in FIG. 28, that the body portions of two JSQ pieces may be joined channel-to-channel, or as shown in FIG. 29, that one jaw member may connect between a JSQ body and another JSQ piece.

The foregoing description of the preferred embodiments of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

The invention claimed is:

1. A toy construction set, including:

a least one jaw piece, said jaw piece including a central body portion having an axis of symmetry, a pair of jaw members extending from said central body portion in spaced apart fashion to define therebetween a jaw opening, said jaw members having confronting jaw surfaces extending parallel to said axis, a pair of inner rails extending parallel to said axis and each protruding from one of said confronting jaw surface into said jaw opening, and means on said central body portion to releasably engage the inner rails of another jaw piece.

2. The toy construction set of claim 1, wherein each of said inner rails extends medially in said confronting jaw surface and occupies approximately one-third of said confronting jaw surface.

3. The toy construction set of claim 1, wherein said means for releasably engaging the inner rails includes a first pair of channels extending in said central body portion in parallel and formed in complementary fashion to said inner rails to receive said inner rails in a close fit, releasably engaged fashion.

4. The toy construction set of claim 3, wherein said central body portion includes a first pair of opposed sides, and said first pair of channels are disposed in said first pair of opposed sides.

5. The toy construction set of claim 4, wherein said first pair of channels extend in a plane that bisects said jaw opening and contains said axis.

6. The toy construction set of claim 2, further including a pair of concave curved surface portions, each formed in one of said confronting jaw surfaces and disposed in confronting opposition to the other.

7. The toy construction set of claim 6, further including a pair of detent lugs protruding from each of said pair of concave curved surface portions, said pair of detent lugs being disposed at laterally opposed sides of said inner rail of said jaw member.

8. The toy construction set of claim 7, wherein said inner rails have mutually confronting inner rail surfaces, and further including a pair of concave recesses, each formed in one of said mutually confronting inner rail surfaces and disposed in confronting opposition to each other.

9. The toy construction set of claim 4, wherein said central body portion includes a second pair of opposed sides, and further including a second pair of channels extending parallel in said second pair of sides and being substantially identical to said first pair of channels in width and depth.

10. The toy construction set of claim 9, wherein said central body portion includes a third pair of channels extending parallel and orthogonal to said first and second pairs of channels, said third pair of channels being substantially identical to said first and second pairs of channels in width and depth.

11. The toy construction set of claim 8, further including a ratchet wheel component, each ratchet wheel component including a pair of ratchet wheels spaced apart along a common axis and defining therebetween an annular land.

12. The toy construction set of claim 11, wherein each of said ratchet wheels includes a plurality of rounded external teeth extending parallel to said common axis and equally spaced about the periphery of the ratchet wheel.

13. The toy construction set of claim 12, wherein said annular land has a diameter substantially equal to the spacing of said mutually confronting inner rail surfaces, whereby said annular land may be received between said confronting rail surfaces in a close fit, frictionally retained manner.

14. The toy construction set of claim 13, wherein said ratchet wheels have a diameter slightly less than the spacing of said concave curved surface portions of said confronting jaw surfaces, whereby said ratchet wheels may be received between said concave curved surface portions when said annular land is inserted between said mutually confronting inner rail surfaces.

15. The toy construction set of claim 14, wherein said detent lugs are disposed to releasably engage said rounded teeth of said ratchet wheels when said annular land is inserted between said mutually confronting inner rail surfaces.

16. The toy construction set of claim 15, wherein said ratchet wheel component extends from one end of said central body portion of said jaw piece and said jaw members extend from the opposite end of said central body portion.

17. The toy construction set of claim 15, further including a first connector piece having a body comprised of said ratchet wheel component, and a pair of connector pins extending axially from opposite ends of said ratchet wheel component.

18. The toy construction set of claim 17, wherein each of said connector pins includes a pair of rib-like protrusions extending parallel to the axis of said pins and disposed in diametrical opposition.

19. The toy construction set of claim 18, wherein each of said connector pins further includes a slot extending diametrically therethough, said slot being oriented orthogonally to the diametrical opposition of said pair of rib-like protrusions.

20. The toy construction set of claim 19, wherein each of said jaw pieces includes a central socket extending along said axis, said central socket including means for engaging said protrusions of said connector pins in an indexed angular orientation.

21. The toy construction set of claim 20, wherein said means for engaging said protrusions include a plurality of rounded internal teeth extending longitudinally in said central socket, said teeth being spaced apart sufficiently to snap-engage said rib-like protrusions of said connector pin inserted in said central socket.

22. The toy construction set of claim 3, further including a central socket extending axially in said jaw piece, and further including a second connector piece having a tubular body and at least one connector pin extending coaxially from said body, said pin being dimensioned to be insertable in said central socket, and means for cooperative engagement of said pin in said central socket for rotating said tubular body at indexed angular increments about the axis of said tubular body.

23. The toy construction set of claim 22, wherein said means for cooperative engagement includes a plurality of rounded internal teeth extending longitudinally in said central socket and equally spaced therein.

24. The toy construction set of claim 23, wherein said means for cooperative engagement includes, a pair of rib-like protrusions secured to said connector pins and extending parallel to the axis of said pins and disposed in diametrical opposition, said protrusions being dimensioned to snap-engage said rounded teeth of said central socket when said connector pin is inserted in said central socket.

25. The toy construction set of claim 22, further including a swivel piece having first and second swivel arms and pivot means for connecting said arms in a variable angular relationship, and means for releasably engaging said second connector piece.

26. The toy construction set of claim 25, wherein said first swivel arm includes a central socket extending into one end thereof, said central socket dimensioned to releasably engage said connector pin.

27. The toy construction set of claim 26, further including a clevis extending from the opposite end of said first swivel arm and defining a clevis slot opening.

28. The toy construction set of claim 27, further including a blade end extending from said second swivel arm and engageable in said clevis slot opening.

29. The toy construction set of claim 28, further including a pivot pin extending through and joining said clevis and said blade end in pivoting, adjustable-angle fashion.

30. The toy construction set of claim 29, further including means for rotating said first and second swivel arms in indexed angular increments.

31. The toy construction set of claim 30, wherein said second swivel arm includes a central socket extending into one end thereof, said central socket dimensioned to releasably engage said connector pin.

32. The toy construction set of claim 29, further including a central socket extending longitudinally through said pivot pin, said central socket dimensioned to releasably engage said connector pin at either end of said central socket.

33. The toy construction set of claim 25, further including further pairs of channels formed in said first and second swivel arms, said further pairs of channels each extending in parallel and formed in complementary fashion to said inner rails to receive said inner rails in a close fit, releasably engaged fashion.

34. The toy construction set of claim 1, further including a central socket extending axially in said jaw piece, a connector piece, and means for cooperative engagement of said connector piece with said central socket for rotating said connector piece at indexed angular increments about the axis of said central socket.

35. The toy construction set of claim 34, wherein said means for cooperative engagement includes a connector pin extending from said connector piece, and at least one rib extending longitudinally and protruding radially from said connector pin.

36. The toy construction set of claim 35, wherein said means for cooperative engagement includes a plurality of rounded internal teeth extending longitudinally in said central socket and equally spaced therein.

37. The toy construction set of claim 36, further including a pair of said protruding ribs secured to said connector pins and extending parallel to the axis of said pins and disposed, in diametrical opposition, said ribs being dimensioned to snap-engage said rounded teeth of said central socket when said connector pin is inserted in said central socket.

38. A toy construction set, including:

a least one jaw piece, said jaw piece including a central body portion having an axis of symmetry, a pair of jaw members extending from said central body portion in spaced apart fashion to define therebetween a jaw opening, said jaw members having confronting jaw surfaces extending parallel to said axis, a pair of inner rails extending parallel to said axis and each protruding from one of said confronting jaw surface into said jaw opening, and means on said central body portion to releasably engage the inner rails of another jaw piece;

said means for releasably engaging the inner rails including a first pair of channels extending in said central body portion in parallel and formed in complementary fashion to said inner rails to receive said inner rails in a close fit, releasably engaged fashion;

said central body portion including a first pair of opposed sides, and said first pair of channels are disposed in said first pair of opposed sides;

further including a pair of outer rails extending parallel to said axis and each extending from one of said jaw members away from said jaw opening, said outer rails being formed in complementary fashion to said first pair of channels to be engageable in said first pair of channels in close fit, releasable fashion.

39. A toy construction set, including:

a least one jaw piece, said jaw piece including a central body portion having an axis of symmetry, a pair of jaw members extending from said central body portion in spaced apart fashion to define therebetween a jaw opening, said jaw members having confronting jaw surfaces extending parallel to said axis, a pair of inner rails extending parallel to said axis and each protruding from one of said confronting jaw surface into said jaw opening, and means on said central body portion to releasably engage the inner rails of another jaw piece;

each of said inner rails extending medially in said confronting jaw surface and occupies approximately one-third of said confronting jaw surface;

further including a pair of concave curved surface portions, each formed in one of said confronting jaw surfaces and disposed in confronting opposition to the other;

a pair of detent lugs protruding from each of said pair of concave curved surface portions, said pair of detent lugs being disposed at laterally opposed sides of said inner rail of said jaw member;

said inner rails having mutually confronting inner rail surfaces, and further including a pair of concave recesses, each formed in one of said mutually confronting inner rail surfaces and disposed in confronting opposition to each other;

said concave recesses and said concave curved surface portions comprising portions of concentric circular arcs that are centered on said axis.

40. A toy construction set, including:

a least one jaw piece, said jaw piece including a central body portion having an axis of symmetry, a pair of jaw members extending from said central body portion in spaced apart fashion to define therebetween a jaw opening, said jaw members having confronting jaw surfaces extending parallel to said axis, a pair of inner rails extending parallel to said axis and each protruding from one of said confronting jaw surface into said jaw opening.

* * * * *